US005690552A

United States Patent [19]

Siddle

[11] Patent Number: 5,690,552

[45] Date of Patent: Nov. 25, 1997

[54] INJECTION MOLDED TELESCOPING BATON

[75] Inventor: Bruce K. Siddle, St. Clair County, Ill.

[73] Assignee: PPCT Products, Inc., Millstadt, Ill.

[21] Appl. No.: 709,718

[22] Filed: Sep. 9, 1996

Related U.S. Application Data

[63] Continuation-in-part of Ser. No. 249,279, May 25, 1994, Pat. No. 5,568,922, which is a continuation-in-part of Ser. No. 141,068, Oct. 26, 1993, Pat. No. 5,372,363.

[51] Int. Cl.[6] ..... F41B 15/02

[52] U.S. Cl. ..... 463/47.7; 135/75

[58] Field of Search ..... 273/84 R, 84 ES; 15/144.4; 135/75; 285/302; 473/48, 283; 343/901; 403/377

[56] References Cited

U.S. PATENT DOCUMENTS

| | | | |
|---|---|---|---|
| 4,157,181 | 6/1979 | Cecka . | |
| 4,325,157 | 4/1982 | Balint et al. | 15/144.4 |
| 4,456,255 | 6/1984 | Braunhut . | |
| 4,752,072 | 6/1988 | Parsons . | |
| 5,110,375 | 5/1992 | Parsons . | |
| 5,160,140 | 11/1992 | Starrett | 273/84 R |
| 5,161,800 | 11/1992 | Parsons et al. . | |
| 5,356,139 | 10/1994 | Parsons | 273/84 R |
| 5,372,363 | 12/1994 | Siddle . | |
| 5,385,323 | 1/1995 | Garelick | 403/377 |
| 5,568,922 | 10/1996 | Siddle . | |

FOREIGN PATENT DOCUMENTS

| | | |
|---|---|---|
| 543517 | 7/1957 | Canada . |
| 0360005 | 3/1990 | European Pat. Off. . |
| 16565 | of 1903 | United Kingdom . |

*Primary Examiner*—William M. Pierce
*Attorney, Agent, or Firm*—Paul M. Denk

[57] ABSTRACT

A telescoping baton having a handle section, a middle section which fits within the handle section, and an end section which fits within the middle section. The middle and end sections can be extended out of or collapsed into the handle section. The handle and middle sections are formed from an injection molded plastic. The end section is constructed of an injection molded skin about a metal core or can be a metal end. A wire clip, or other fastener, located in the end cap on the handle section, engages a bore or back end of the end section when the baton is collapsed thereby releasably holding the baton in a collapsed state. Alternatively, there can be a magnet in the handle section that engages the metal in the end section. All three sections of the baton are injection molded in the same mold at the same time.

4 Claims, 3 Drawing Sheets

1
3
11
15
37

1
5
7
3
14
11
21
27
23
15
37
27

1
3
7
14
11
17
19
21
27
29
31
35
37

INJECTION MOLDED TELESCOPING BATON

This is a continuation in part of application Ser. No. 08/249,279, filed on May 25, 1994, now U.S. Pat. No. 5,568,922 which is a continuation in part of application Ser. No. 08/141,068, filed on Oct. 26, 1993, now U.S. Pat. No. 5,372,363.

BACKGROUND OF THE INVENTION

This invention relates generally to batons, more particularly to a light-weight telescoping baton, and method of making the same constructed from an injection molded material for use by policemen, security or the like, in the field or during training exercises.

Expandable or telescoping batons are often carried by law enforcement officers or security personnel instead of the traditional, one-piece night stick. Typically, the traditional night stick is made of wood and is approximately 26 inches long and 1¾ inches in diameter. Long, one-piece night sticks are inconvenient to carry for obvious reasons.

Expandable batons have increased in popularity because, in the collapsed state, the over all length of the baton can be as short as eight or nine inches. Generally, expandable batons are constructed in sections which telescope. A tubular main section fractions as a handle; progressively smaller, tubular sections fit within each other and can be collapsed into one another or expanded outward. When completely collapsed, the sections all fit within the handle section. When expanded, the sections are locked together, end-to-end, by friction fittings such as taper joints. When expanded, the over all length of the baton can be 18 to 20 inches.

Prior art expandable or telescoping batons are constructed from metal such as soft steel. Batons made from hard steel provide better service but are expensive to manufacture, as are batons constructed from alloy steel. Metal batons have notable drawbacks. The metal is prone to metal fatigue and can crack or rust. Furthermore, metal batons bear a close similarity to a piece of metal pipe, which is aesthetically unpleasant.

The unique composite expandable baton disclosed in my U.S. Pat. No. 5,372,363, alleviates many of the problems associated with prior art metal batons. The filament winding prohibits separation and structurally strengthens the joint. I have determined that baton components formed of a composite material by the continuous winding of glass and Kevlar® filaments in epoxy allows for the optimal winding of the filaments at the joint area so as to provide a structurally strengthened joint that resists joint fatigue and separation.

I have determined that a baton constructed from a filament winding procedure creates a baton that is superior to metal batons. However, such batons, although extremely well-suited for their intended purposes, are somewhat expensive to manufacture. Therefore, I have determined that a baton having novel injection molded components made in accordance with the present invention functions quite well for its intended purposes, but is less costly and easier to manufacture.

SUMMARY OF THE INVENTION

It is, therefore, a principal object of the present invention to provide a telescoping baton made of injection molded components.

Another object of the invention is to provide a telescoping baton that is made of injection molded components that can be manufactured using novel injection molding techniques.

Still another object of the present invention is to provide a telescoping baton that has an optimums strength-to-weight ratio, is easy and economical to manufacture, and well suited for its intended purposes.

Yet another object of the invention is to provide a telescoping baton that has three interconnected sections that are all molded at the time in the same mold so as to provide an economic method of manufacturing the baton.

In accordance with the invention, generally stated, a telescoping baton is provided having a handle section, a middle section which fits within the handle section, and an end section which fits within the middle section. The middle and end sections can be extended out of or collapsed into the handle section. The handle and middle section are formed from an injection molded plastic or polymer. The end section is constructed of an injection molded skin about a metal core or can be a metal end. A wire clip, or other holding or fastening means, located in the end cap on the handle section, engages a bore or other port in the end section when the baton is collapsed thereby releasably holding the baton in a collapsed state. Alternatively, there can be a magnet in the handle section that engages the metal in the end section. The hand, middle and end sections all are injection molded in the same mold at the same time so as to economically manufacture the components of the baton.

DESCRIPTION OF THE PREFERRED EMBODIMENT

Figures 1, 2, 3:
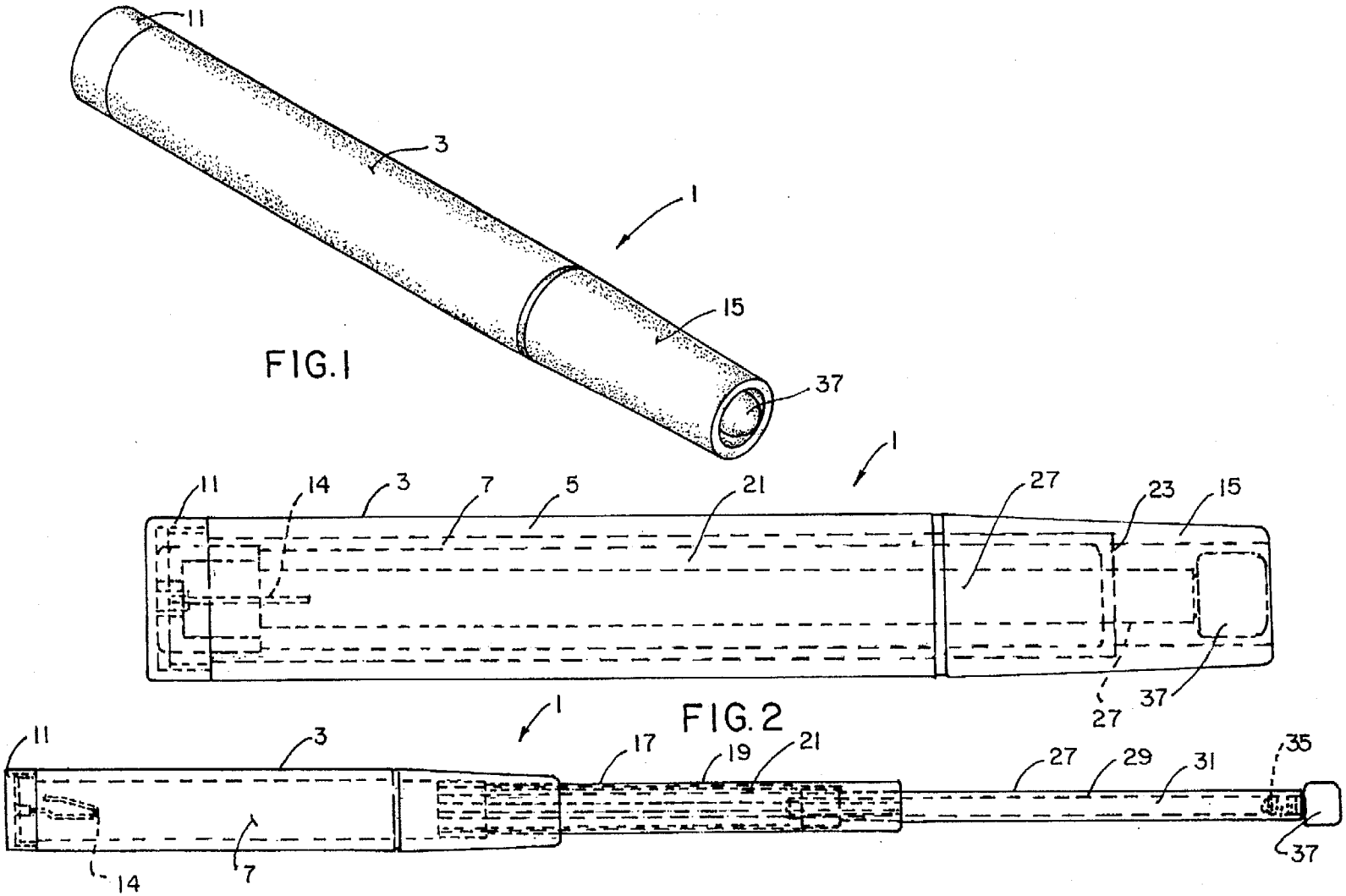
FIG. 1 is a perspective view oft he telescoping baton of the present invention in the collapsed state.
FIG. 2 is a side elevational view of the telescoping baton of the present invention in a collapsed state, showing the arrangement of the internal elements in phantom.
FIG. 3 is a side elevational view of the telescoping baton of the present invention in an extended state, showing the arrangement of the internal elements in phantom.

A telescoping baton of the present invention is indicated generally b reference numeral 1 in the figures. Baton 1 is shown in a collapsed state in FIGS. 1 and 2 and extended position in FIG. 3. Baton 1 is comprised of a handle section 3 which is formed of a cylindrical wall 5 defining an internal bore 7. Handle section 3 can be formed from an appropriate injection moldable material such as thermoplastic or the like as will be explained below. Bore 7 has a diameter slightly greater than the outside diameter of the second section as will be described below.

Figures 4, 5, 6, 7:
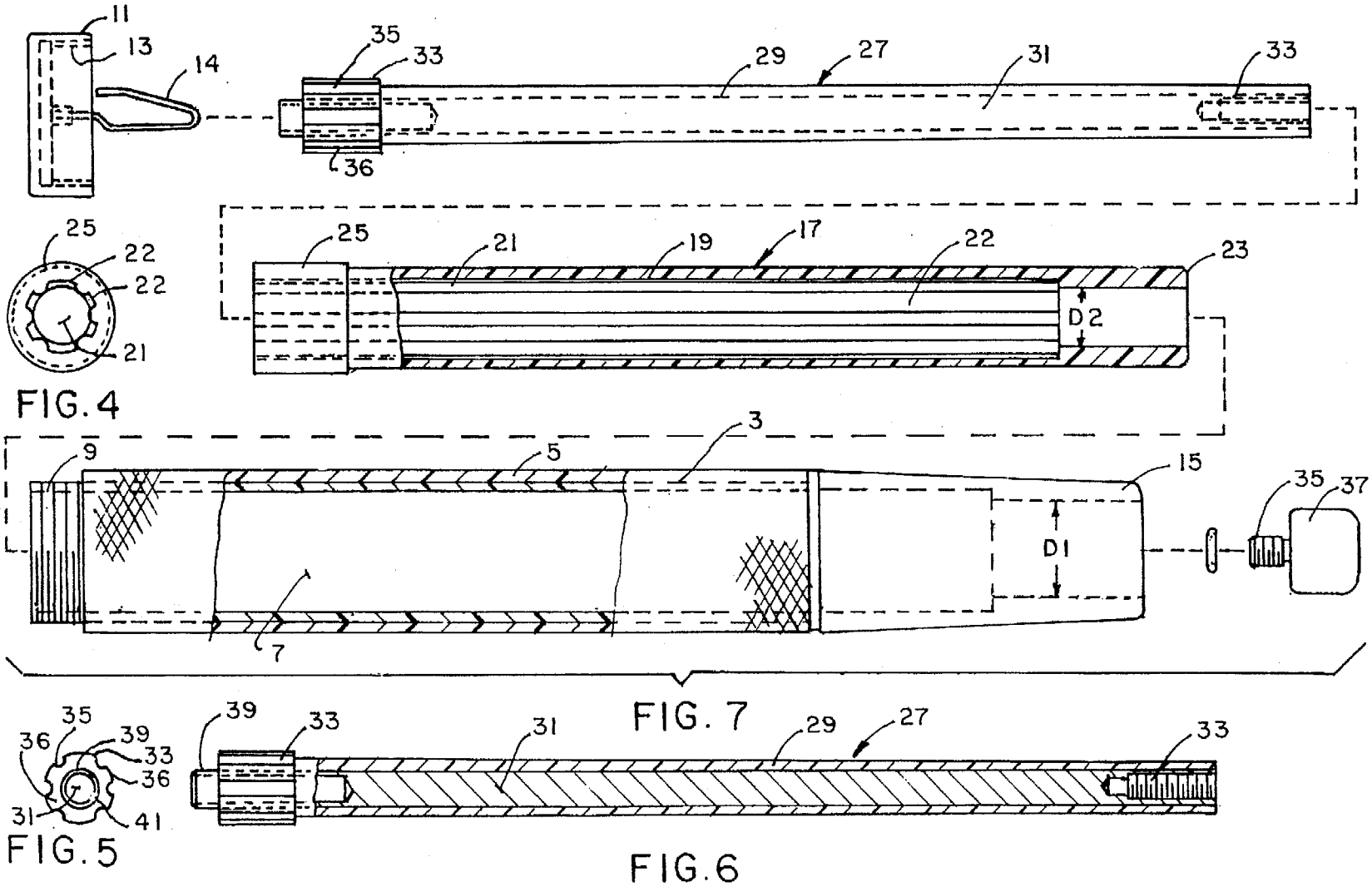
FIG. 4 is an end plan of the middle section.
FIG. 5 is an end plan of the end section.
FIG. 7 is an exploded view of the telescoping baton of the present invention.

Handle section 3 has threads 9 (FIG. 7) formed eternally on the aft end for the threaded engagement of end cap 11. End cap 11 has internal threads 13 to engage threads 9. A wire clip 14 is positioned centrally and extends outwardly from cap 11 to releasably secure the baton in a collapsed state as will be explained below. The forward end of handle 3 has a beveled head 15. Bore 7 is swaged down to reduce the diameter D1 within head 15. Obviously, any other type of holding means, such as a fastener, magnet, or the like can be used in lieu thereof.

A second section 17 is formed from cylindrical wall 19 which defines an inner bore 21. The inner bore wall has a series of longitudinal grooves 22 formed therein. Wall 19 has an outside diameter Slightly less than diameter of bore 7 in handle 3 so that section 17 can fit within bore 7. Section 17 is formed from any appropriate injection molded material such as thermoplastic or the like. Bore 21 is swaged down to reduce the diameter D2 at a first or forward end 23. The aft section has an external collar 25. The outside diameter of collar 25 is essentially the same as diameter D1 in the forward end of bore 7 of handle section 3.

An end section 27 is formed from cylindrical wall 29 which defines bore 31. End section 27 is shown in greater detail in FIGS. 5 and 6. Forward end of bore 31 has internally threaded metal tubular insert 33 to engage the threaded portion 35 of metal end knob 37. The aft end of section 27 has an external collar 33 formed thereon. Collar 33 has essentially the same outside diameter as the diameter D2 of the swaged end of bore 21 of middle section 17. Collar 33 also has a plurality of grooves 35 (FIG. 5) formed therein defining a plurality of ribs 36. It will be appreciated that ribs 36 are dimensioned and positioned to slidingly engage grooves 22 (FIG. 4) formed in the bore of the middle section. This rib and groove arrangement allows end section 27 to slide inside the middle section without rotating therein.

A short hollow metal tube 39 with an outside diameter slightly less than diameter of bore 31, is inserted into bore 31 and protrudes out of the aft end. Tube 39 includes a bore 41 that can accept and hold the wire clip 14 to releasably hold the baton in a a collapsed arrangement. Alternatively, end section 39 can be molded as a thin skin around a metal rod extending the entire length of the section to add weight and rigidity to the end of the baton.

In use, the arrangement of the elements are as indicated in FIGS. 2 and 3. Second section 17 fits within bore 7 of handle piece 3. End section 27 fits within bore 21 of second section 17. When collapsed the wire loop 14 engages bore 41 of the metal tube 39. In an alternative embodiment, a magnet can be secured in cap 11 and the magnet engages the metal tube 39. The magnetic attraction releasably holds the baton in a collapsed state. In any event, a sharp swing of the middle in arc causes the metal knob 37 to exert force so that the inner telescoping sections thrust outward under centrifugal force. Collar 33 on end piece 27 engages the swaged section at diameter D2 of internal bore 21 of the second section thereby releasably locking it in place. Correspondingly, collar section 25 of second section 17 engages the diameter D1 at the swaged end of internal bore 7 of handle 3 also locking it in place. This arrangement is best illustrated in FIG. 3.

To retract the various elements of the baton, the user strikes the metallic knob 37 against the floor or wall driving the collar sections 33 and 25 away from the swaged diameters D2 and D1 respectively thus allowing the telescoping sections to collapse within each other. Wire loop 14 engages bore 41 of tube 39 as previously described.

Figure 8:
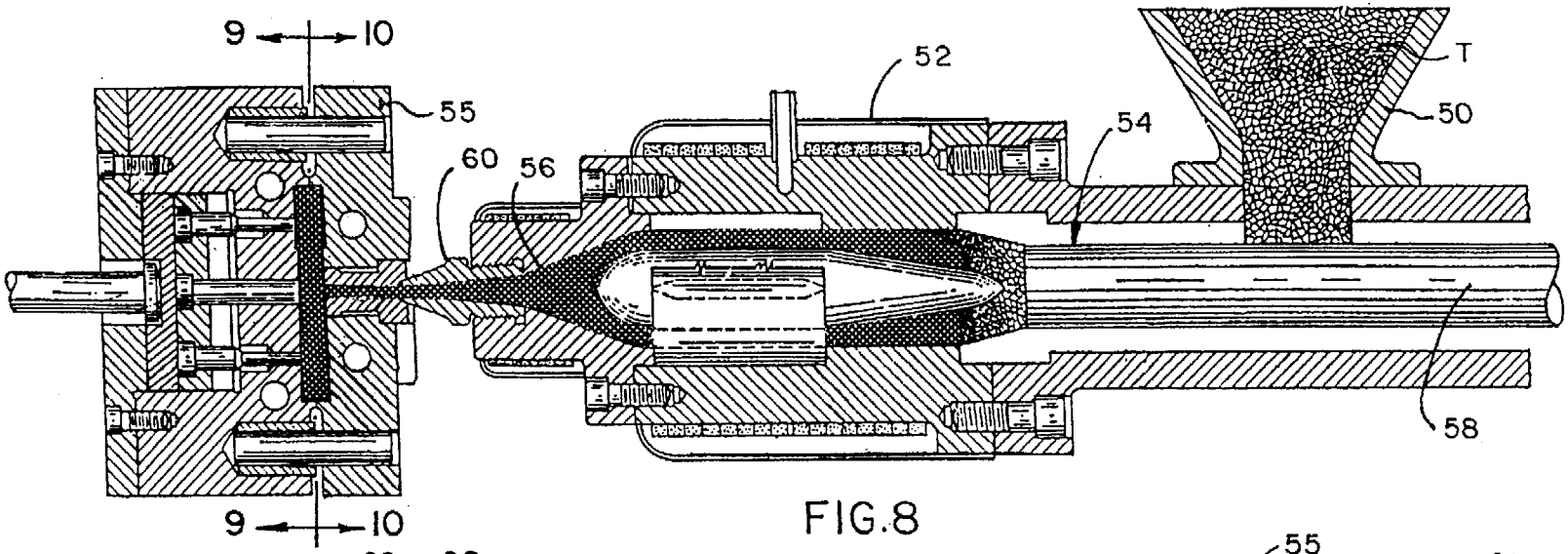
FIG. 8 is a schematic illustrating of the injection molding of the components of the telescoping baton of the present invention.
Figure 10:
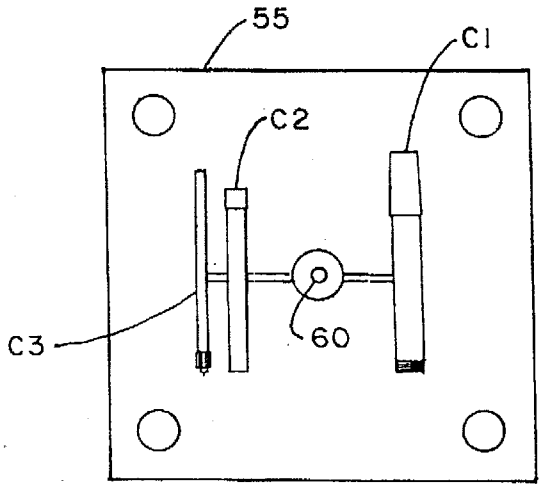
FIG. 10 is the opposite half of the mold of FIG. 9.
Figure 9:
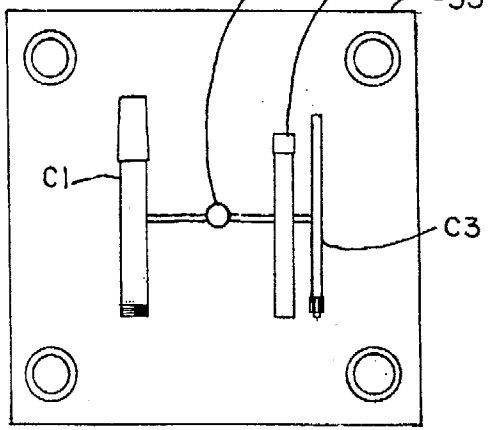
FIG. 9 is one-half of a mold for the three sections of the telescoping baton of the present invention.

The telescoping baton is constructed by a novel injection molding process as indicated generally by FIGS. 8–10. The thermoplastic material that forms the various sections can be softened by heat and reharden when cooled. As shown in FIG. 8, granular thermoplastic material T, of the type customarily used for injection molding, is loaded into a hopper 50 from which it is metered to a heating cylinder 52 by a feeding device 54. The exact amount of molten material required to fill a mold 55 is delivered to a cylinder 56. An injection ram 58 pushes the material into the heating cylinder and in doing so pushes a like amount of heated material out of the other end through a nozzle 60 and sprue bushing into the cavities C1–C3 of the closed mold. The material generally is heated to a temperature between 350° and 525°. The material then is cooled to a rigid state in the mold. Sometimes the mold is kept cold with circulating water to cool the material as it flows into the cavities. The mold is then opened and the pieces ejected.

As can be seen in FIGS. 9 and 10, the respective cavities C1, C2 and C3 correspond to the hand, middle and end sections of the baton as described above. Contrary to conventional techniques wherein a mold is made for each injection molded element, all three sections, therefore, can be molded at one time in a quick and economical process.

It will be obvious to those skilled in the art that various changes or modification can be made in the expandable baton of the present invention without departing from the scope of the appended claims. Therefore, the preceding description and accompanying drawings are intended to be illustrated only and should be construed in a limiting sense.

I claim:

1. A telescoping baton for use in self-defense or training, comprising:

a cylindrical handle section having an end and axial bore formed therein, said handle section formed from an injection molded material;

a cylindrical second section disposed within said axial bore of said handle section and being capable of being extended out of said handle section or retracted into said handle section, said second section having an axial bore formed therein, said second section being formed from said injection molded material simultaneously with said handle section;

an end section disposed within said second section and capable of being extended out of said second section and retracted into said second section, said end section having an axial bore formed therein, said end section being formed of said injection molded material simultaneously with said handle and said second sections;

an internally threaded first metal tube within a first end of said axial bore of said end section and a metal knob threadedly engaged within said first metal tube, a second metal tube within a second end of said axial bore of said end section;

an end cap on said handle end, said end cap having a fastening means provided to releasably engage said second metal tube within said axial bore of said end section to provide a holding means for retaining the telescoping baton in its retracted position, said end cap being removable to allow assembly of said sections;

said axial bore of said second section being defined by a wall which has a plurality of grooves formed therein and said end section includes a raised collar, said collar having a plurality of ribs formed thereon, said ribs disposed to slidingly engage said grooves to allow said end section to extend out of and retract into said second section while preventing rotation of said end section within said second section axial bore, whereby telescoping sections of said baton may be extended, during usage, and retracted, during storage.

2. The telescoping baton of claim 1 whereto said collar connects to the proximate ends of said first and second metal tubes.

3. The telescoping baton of claim 1 where in said fastening means comprises a clip protruding from said end cap.

4. The telescoping baton of claim 2 wherein said fastening means comprises a magnetic fastening means.

* * * * *